US009016525B2

(12) United States Patent
Henderson

(10) Patent No.: US 9,016,525 B2
(45) Date of Patent: Apr. 28, 2015

(54) BEVERAGE DISPENSER FOR ALCOHOLIC BEVERAGES

(76) Inventor: Jeffrey D. Henderson, Dover, NH (US)

( * ) Notice: Subject to any disclaimer, the term of this patent is extended or adjusted under 35 U.S.C. 154(b) by 61 days.

(21) Appl. No.: 13/565,317

(22) Filed: Aug. 2, 2012

(65) Prior Publication Data

US 2014/0034678 A1 Feb. 6, 2014

(51) Int. Cl.
*B67D 3/00* (2006.01)

(52) U.S. Cl.
CPC ..... *B67D 3/0035* (2013.01)

(58) Field of Classification Search
USPC ..... 222/185.1, 481.5, 478, 479, 482, 488
See application file for complete search history.

(56) References Cited

U.S. PATENT DOCUMENTS

| | | | | | |
|---|---|---|---|---|---|
| 948,883 | A * | 2/1910 | Hughes | 222/129 |
| 2,056,863 | A * | 10/1936 | Napier | 222/185.1 |
| 2,551,842 | A * | 5/1951 | Kirchner | 222/129 |
| 4,386,718 | A * | 6/1983 | Stewart et al. | 222/185.1 |
| 4,646,944 | A * | 3/1987 | Sanderson | 222/108 |
| 5,405,058 | A * | 4/1995 | Kalis et al. | 222/185.1 |
| 5,928,741 | A * | 7/1999 | Andersen et al. | 428/35.7 |
| 6,053,367 | A * | 4/2000 | Pejoine | 222/185.1 |
| 6,527,145 | B1 * | 3/2003 | Bennett, Jr. | 222/185.1 |
| 6,892,903 | B1 * | 5/2005 | Bartolotta | 222/185.1 |
| 8,596,500 | B2 * | 12/2013 | Antonetti | 222/185.1 |
| 2008/0047979 | A1 * | 2/2008 | Lee | 222/185.1 |

* cited by examiner

*Primary Examiner* — Donnell Long
(74) *Attorney, Agent, or Firm* — Mesmer & Deleault PLLC

(57) ABSTRACT

A beverage dispenser for use with a beverage container containing an alcoholic beverage includes a base with an upper outside surface, a vertically-inclined bore within the base, a valve bore in fluid communication with and transverse to the vertically-inclined bore, and a vent formed in the base to maintain fluid communication between the vertically-inclined bore and the atmosphere external to the base where the vertically-inclined bore extends a first pre-defined distance into the base from the upper outside surface and defines an upper opening in the base for receiving a neck portion of an inverted beverage container and where the valve bore extends a second pre-defined distance into the base and fluidly communicates with a lower portion of the vertically-inclined bore.

13 Claims, 6 Drawing Sheets

BEVERAGE DISPENSER FOR ALCOHOLIC BEVERAGES

BACKGROUND OF THE INVENTION

1. Field of the Invention

The present invention relates generally to beverage dispensers and more specifically to a beverage dispenser particularly suited for alcoholic beverages.

2. Description of the Prior Art

Beverage dispensers of the prior art include water coolers, water bottle supports for purified drinking water, and beverage dispensers for liquor. Many beverage dispensers are designed for water and typically have a containment vessel that contains water from a refill bottle. A seal between the bottle and the vessel helps to prevent bacteria build up in the vessel as well as to prevent entry of foreign debris to the vessel.

One dispensing system has a non-metallic bottle and a dispensing device with a tap. A connector joins the dispensing device to the neck of the bottle in a liquid-tight manner. The bottle is positioned upside down for dispensing to take place through the dispensing device. This position also allows the connecting piece to hold a ventilation pipe extending inside the bottle from the connecting piece upwards to the bottom of the bottle.

In another liquid dispenser described in U.S. Pat. No. 4,386,718, an inverted, rigid, screw-neck bottle screws onto an upwardly-directed threaded socket in the base to form a liquid-tight seal between the bottle and the base. The base has a port to release liquid to a threaded nose that is coupled to a tap. An air bleed arrangement delivers atmospheric air through a stem that extends into the bottle when the bottle is mounted on the base.

SUMMARY OF THE INVENTION

As described above, beverage dispensers of the prior art share the common feature of forming an air-tight or liquid-tight seal between the bottle and the vessel or base. Because of the need to form an air-tight seal with the bottle neck, the dispensing systems of the prior art are not designed to accommodate beverage containers of various sizes, shapes, and materials. Since water, liquor, wine, and other beverages often are packaged in bottles particular to the beverage, beverage dispensers of the prior art are unable to accommodate beverage containers other than the particular type intended for the given dispenser. Some dispensers are designed only for flexible containers (e.g., plastic water bottles), while others are designed for rigid containers of glass or metal. Some dispensers are configured to only accept a bottle with a particular threaded neck.

A liquid-tight seal requires an internal vent to the bottle. A vent tube extending upward into the base of the bottle is adapted to a bottle of a specific dimension and is therefore generally not suitable for use with beverage containers of differing sizes. Because of these and other considerations, beverage dispensers of the prior art are particularly ill-suited for use with a variety of manufactured beverage containers that contain wines, liquor, and other non-carbonated beverages. Accordingly, a need exists for an improved beverage dispenser particularly suited for alcoholic beverages.

It is an object of the present invention to provide a beverage dispenser that supports a beverage container and that operates with beverage containers of various sizes, shapes, and materials.

It is another object of the present invention to provide a beverage dispenser having a vent that is external to the bottle or beverage container.

It is a further object of the present invention to provide a beverage dispenser capable of dispensing beverages without the need for an air- or liquid-tight seal between the beverage container and the dispenser.

These and other objects are achieved by providing a beverage dispenser for use with a beverage container containing an alcoholic beverage. In one embodiment, the beverage dispenser has a base with an upper outside surface and a vertically-inclined bore within the base, a valve bore in the base in fluid communication with and transverse to the vertically-inclined bore, and a vent formed in the base to maintain fluid communication between the vertically-inclined bore and the atmosphere external to the base. The vertically-inclined bore extends a first pre-defined distance into the base from the upper outside surface and defines a top opening in the base for receiving a neck portion of an inverted beverage container. The valve bore extends a second pre-defined distance into the base and fluidly communicates with a lower portion of the vertically-inclined bore.

In another embodiment of the present invention, at least a portion of the valve bore is threaded and configured for threadably receiving one of a spigot, a valve, a dispensing faucet, or a fluid dispenser.

In another embodiment of the present invention, at least a portion of the vertically-inclined bore is threaded and configured for threadably receiving a threaded neck portion of the beverage container.

In another embodiment of the present invention, the beverage dispenser has a dispensing faucet with a faucet stem, where the faucet stem is disposed in the valve bore. The faucet stem forms a liquid-tight seal with an inside surface of the valve bore for controlling the flow of a beverage from the beverage container through the valve bore. In another embodiment of the present invention, the liquid-tight seal is formed by an adhesive, a sealable threaded connection, or a pressure-fit.

In another embodiment of the present invention, the vent has a vent bore that extends partially into the base from the upper outside surface. The vent bore extends in fluid communication along a major portion of the vertically-inclined bore.

In another embodiment of the present invention, a sealant is disposed on the inside surface and/or on an outside surface of the base. In one embodiment, the sealant is water-based polyurethane. In another embodiment, the sealant is an oil-based sealant such as an oil-based stone glamor.

In another embodiment of the present invention, the beverage dispenser includes an annular sleeve that is removably positionable into the vertically-inclined bore where the sleeve has an opening therethrough that is configured for receiving the neck portion of the inverted beverage container. In one embodiment, the annular sleeve has a first inner diameter at a top opening and a second inner diameter at a bottom opening, where the second inner diameter is smaller than the first inner diameter.

In still another embodiment of the present invention, the annular sleeve is configured to create a vent between the vertically-inclined bore and the atmosphere external to the base. The vent has a venting structure selected from the group consisting of one or more longitudinal vent conduits within the sleeve, one or more longitudinal slots along an outside surface or an inside surface of the sleeve, one or more longitudinal grooves along an outside surface or an inside surface of the sleeve, and one or more longitudinal ridges along an outside surface or an inside surface of the sleeve.

In another embodiment of the present invention, the base further includes a vent bore in fluid communication with the vertically-inclined bore and extending the pre-defined distance substantially parallel to the vertically-inclined bore and partially through the base from the upper outside surface, and where the annular sleeve further includes a protrusion shaped and configured to occupy at least an upper portion of the vent bore.

In another embodiment of the present invention, the alcoholic beverage is non-carbonated. In another embodiment, the alcoholic beverage is a distilled liquor.

In yet another embodiment of the present invention, the beverage dispenser is combined with a bottle of distilled liquor having a neck, where the neck is at least partially disposed within the vertically-inclined bore.

DETAILED DESCRIPTION OF THE PREFERRED EMBODIMENT

Figure 1:
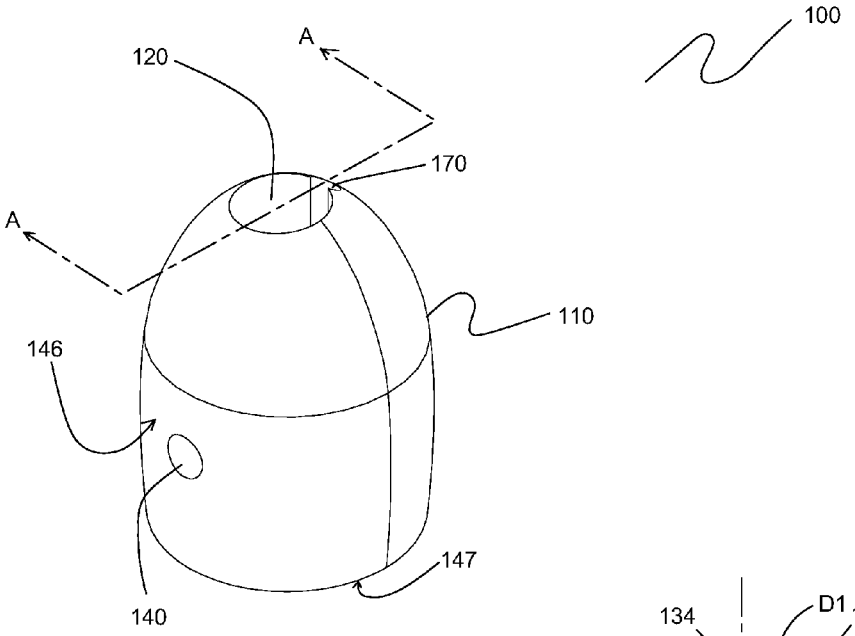
FIG. 1 illustrates a perspective view of one embodiment of a beverage dispenser of the present invention, showing a base, a vertically-inclined bore, a valve bore, and an optional vent bore.

The preferred embodiment of the present invention is illustrated in FIGS. 1-12. FIG. 1 illustrates a perspective view of one embodiment of a beverage dispenser 100 that has a base 110 with an outer surface 146. Base 110 has a substantially vertical vertically-inclined bore 120 and a valve bore 140 transverse to and in fluid communication with vertically-inclined bore 120. Base 110 shown in FIG. 1 also illustrates an embodiment of an optional vent bore 170 that extends in fluid communication along all or at least a major portion of vertically-inclined bore 120.

Base 110 is preferably a block-like object with a substantially-flat bottom surface 147 for placement on a horizontal surface and of sufficient mass to support a beverage container 300 (shown in FIG. 6) in an inverted position. It is contemplated that if legs are attached to base 110, then base 110 may not have a substantially-flat bottom surface since the legs would support base 110 of beverage dispenser 100. In one embodiment, base 110 is a rock or block of stone, such as granite, river rock, cobblestone, fieldstone, and the like. In other embodiments, base 100 is a block or other shape of glass, wood, concrete, metal, or another material.

Figure 2:
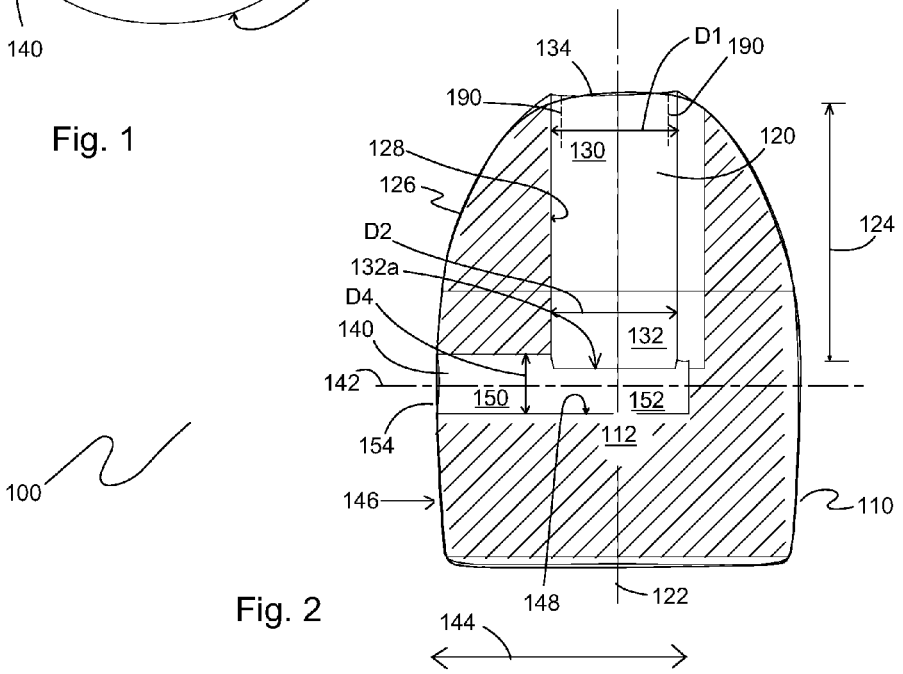
FIG. 2 illustrates a cross-sectional side view of the beverage dispenser of FIG. 1 showing the relationship between the vertically-inclined bore, valve bore, and optional vent bore along line A-A.

Referring to FIG. 2, which shows a side cross-sectional view of base 110 along line A-A of FIG. 1, vertically-inclined bore 120 preferably extends substantially along a vertical axis 122 a pre-defined distance 124 partially into base 110 from an upper outside surface 126 of base 110. For purposes of the Figures, upper outside surface 126 is considered that portion of outer surface 146 which extends from the lowest most point of vertically-inclined bore 120 to the upper most surface of outer surface 146. Vertically-inclined bore 120 may also extend at an angle incident to vertical axis 122. Vertically-inclined bore 120 has an upper portion 130, a lower portion 132, and a diameter D1. Vertically-inclined bore 120 defines an opening 134 in upper outside surface 126 and an inside surface 128. In one embodiment, opening 134 preferably has a diameter D1 between about 1.25 inches and about 2.25 inches, with a more preferred diameter D1 of about 1.5 inches. Vertically-inclined bore 120 in some embodiments has diameter D1 along its entire pre-defined distance 134. Diameter D1 of more than 2.0 inches may be required in some embodiments to accommodate specialty bottles that have a square neck or a round neck with a neck diameter or diagonal of about 2 inches. In other embodiments, vertically-inclined bore 120 is optionally tapered, where a diameter D2 at a location vertically below opening 134 (e.g., at or near lower portion 132). Optionally, vertically-inclined bore 120 (preferably upper portion 130) is threaded with threads 190 to accept a threaded beverage container 300 (not shown).

Pre-defined distance 124 of vertically-inclined bore 120 is preferably between about 2 and about 5 inches, with a more preferred pre-defined distance 124 of about 3.5 inches into base 110.

Valve bore 140 extends along a longitudinal axis 142 in a direction transverse to vertically-inclined bore 120. Valve bore 140 extends a second pre-defined distance 144 into base 110 from a side wall 146 of base 110. Valve bore has an outer portion 150 and an inner portion 152. Valve bore 140 defines a valve bore inside surface 148 and a valve bore opening 154 in side wall 146. Inner portion 152 of valve bore 140 is positioned towards a radially-innermost portion 112 of base 110 and fluidly connects with or intersects lower portion 132 of vertically-inclined bore 120. In some embodiments, valve bore 120 is substantially horizontal (i.e., perpendicular to vertical axis 122). In other embodiments, valve bore 120 is angled downward or upward from inner portion 152 to outer portion 150 where inner portion 152 is in fluid communication with lower portion 132 of vertically-inclined bore 120. Valve bore opening 154 is positioned to be vertically below an opening 302 (not shown) of beverage container 300 (not shown). To accomplish this relationship for a variety of beverage containers 300, valve bore opening 154 is preferably at or below a bottom 132*a* of vertically-inclined bore 120. Although the bottom of vertically-inclined bore 120 is shown intersecting only partially into valve bore 120, it should be understood that the bottom of vertically-inclined bore 120 may extend to the lower limits of valve bore 120 or beyond.

Valve bore in some embodiments has a valve bore diameter D4 of about ½ inch. Other valve bore diameters D4 are also acceptable, depending on the valve and/or dispenser selected and accompanying adapters, connectors, and other hardware used to seal the dispenser within valve bore 150. In some embodiments, an outer portion 150 of valve bore 140 is threaded for threaded engagement with a threaded valve, dispenser, faucet, or other fitting.

Figure 3:
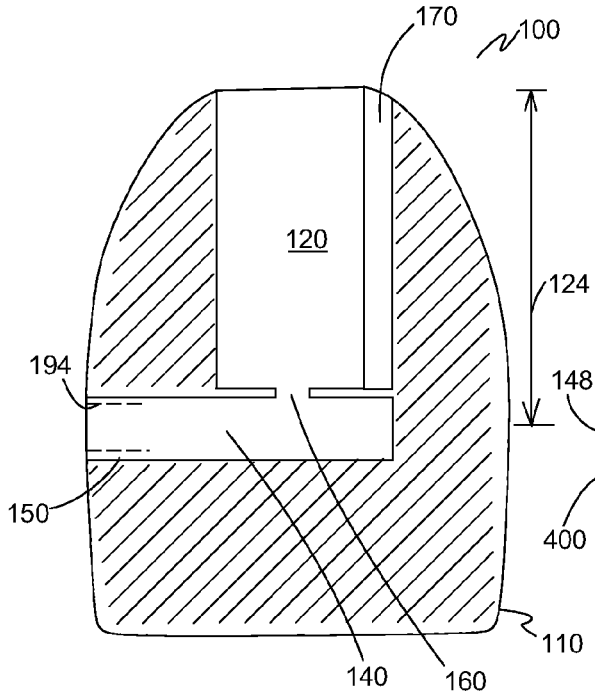
FIG. 3 illustrates a cross-sectional side view of another embodiment of a beverage dispenser of the present invention showing one mode of fluid communication between the vertically-inclined bore and the valve bore.

Referring now to FIG. 3, there is illustrated a side cross-sectional view of another embodiment of beverage dispenser 100. Valve bore 140 is positioned vertically below vertically-inclined bore 120 where valve bore 140 does not intersect vertically-inclined bore 120 but is in fluid communication with vertically-inclined bore 120. In this embodiment, an opening or channel 160 connects vertically-inclined bore 120 with valve bore 140 to allow fluids to flow between vertically-inclined bore 120 and valve bore 140. In other words, channel 160 allows fluid communication between vertically-inclined bore 120 and valve bore 140. As shown, optional vent bore 170 extends adjacent to and is in fluid communication with vertically-inclined bore 120 along the pre-defined distance 124. As also shown in FIG. 3, for example, valve bore 140 optionally has threads 194, preferably located in outer portion 150 of valve bore 140.

Figure 4:
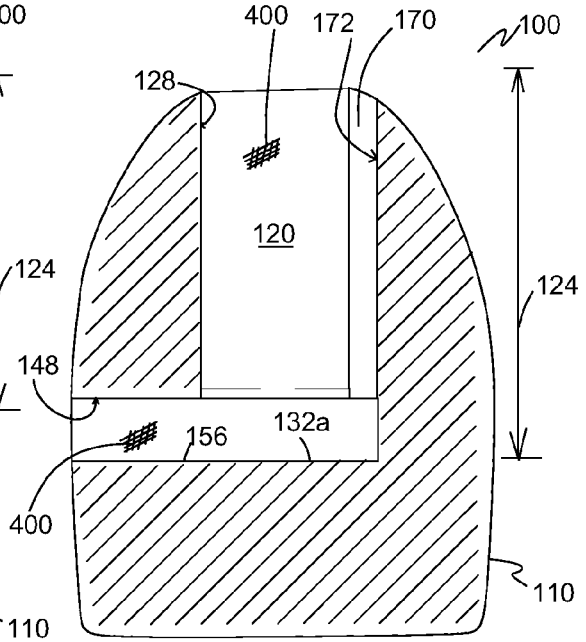
FIG. 4 illustrates a cross-sectional side view of another embodiment of a beverage dispenser of the present invention showing another mode of fluid communication between the vertically-inclined bore and the valve bore.

Turning to FIG. 4, there is shown a side cross-sectional view of another embodiment of beverage dispenser 100 with base 110 having optional vent bore 170. In this embodiment, a bottom margin 156 of valve bore coincides with or is collinear with bottom 132*a* of vertically-inclined bore 120. Vent bore 170 preferably extends adjacent to and intersects vertically-inclined bore 120 for fluid communication with vertically-inclined bore 120. In the embodiment illustrated, vent bore 170 extends along entire pre-defined distance 124 and defines inside surface 172 of vent bore. It is contemplated that the length of vent bore 170 may vary so long as it communicates with vertically-inclined bore 120. For example, vent bore 170 may extend only one or two inches even though vertically-inclined bore 120 extends more that two inches into base 110. The key factor is that vent bore 170 intersect at a point along vertically-inclined bore 120 to allow sufficient fluid communication of the vertically-inclined bore 120 with the atmosphere outside of base 110. FIG. 4 also shows a sealant 400 disposed on inside surfaces 128, 148 of vertically-inclined bore 120 and valve bore 140, respectively. Sealant 400 may be applied to any or all surfaces, inside and out, of base 110. Sealant 400 is preferably water-based polyurethane, but may be an oil-based sealant, such as stone glamor as is known in the art.

It is noted that despite the Figures of the preferred embodiment showing the vertically-inclined bore 120 as being substantially centrally located within base 110, vertically-inclined bore 120 does not need to be positioned along a central axis of base 110 and, thus, the Figures should not be construed as being limiting. This would be particularly so for bases configured in other shapes/designs or where multiple alcoholic beverage containers are mounted into a base containing a plurality of vertically-inclined bores and valves/spigots.

Figure 5:
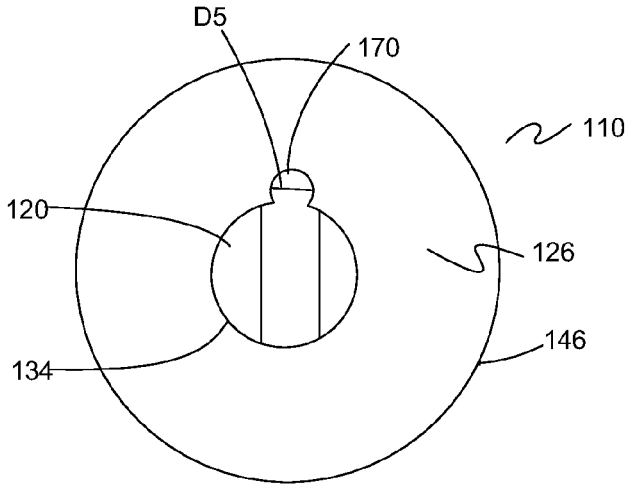
FIG. 5 illustrates a top view of one embodiment of a beverage dispenser of the present invention showing a vertically-inclined bore and a vent bore.

Referring to FIG. 5, which shows a top view of one embodiment of base 110, vent bore 170 intersects vertically-inclined bore 120. Vent bore 170 has a preferred diameter D5 of about ½" in some embodiments. In another embodiment, vent bore 170 extends diagonally downward from upper outside surface 126 to intersect vertically-inclined bore 120 at lower portion 132 or some other location that is vertically-below opening 134 in upper outside surface 126 of base 110. For example, vent bore 170 may pass diagonally from upper outside surface 126 to a point in vertically-inclined bore 120 to provide external venting to the beverage for equilibration with the atmosphere.

Figure 6:
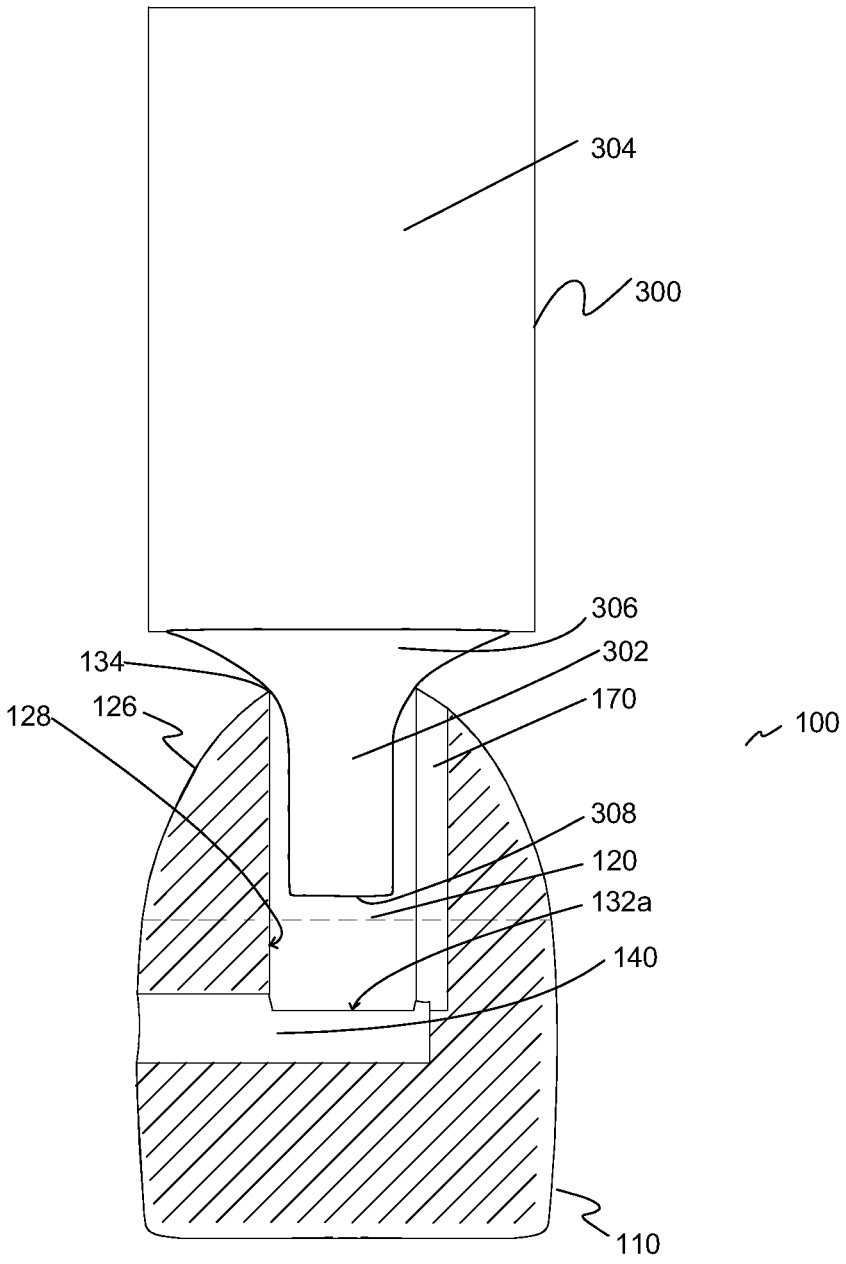
FIG. 6 illustrates a cross-sectional side view of the beverage dispenser of FIG. 1 showing a beverage container, a vent bore, a vertically-inclined bore, and a valve bore.

Turning now to FIG. 6, there is shown a side cross-sectional view of base 110 with beverage container 300 disposed on base 110 in an inverted position. Base 110 has vertically-inclined bore 120, valve bore 140, and vent bore 170. Beverage container 300 has a neck 302, a mouth 308, a reservoir portion 304, and a shoulder portion 306 that typically tapers between neck 302 and reservoir portion 304. Beverage container 300 is supported by base 110 with neck 302 extending into vertically-inclined bore 120. When neck 302 is long enough, mouth 308 may rest on bottom 132*a* of vertically-inclined bore 120. Alternately, and as shown here, shoulder portion 306 of beverage container 300 is supported around opening 134 by upper outside surface 126 of base 110. To avoid a vacuum forming within beverage container 300 or vertically-inclined bore 120 when beverage is dispensed, vent bore 170 provides external venting to beverage container 300 and permits a non-sealing interface between a neck 302 of beverage container 300 and inside surface 128 of vertically-inclined bore 120. This is so even when neck 302 firmly contacts inside surface 128 of vertically-inclined bore 120 because beverage container 300 does not occupy vent bore 170. Accordingly, vent bore 170 freely permits equilibration between the atmosphere and vertically-inclined bore 120.

Vent bore 170 is particularly useful when beverage container 300 is made of plastic and has neck 302 that increases in size towards reservoir portion 304 of beverage container 300. Without vent bore 170, some such beverage containers are capable of forming an air- or liquid-tight seal with inside surface 128 of vertically-inclined bore 120. Without vent bore 170, this air- or liquid-tight seal does not allow beverage container and beverage contained in vertically-inclined bore 120 to equilibrate with the atmosphere to dispense the beverage contained therein when a valve or spigot is attached to valve bore 140.

Figure 8:
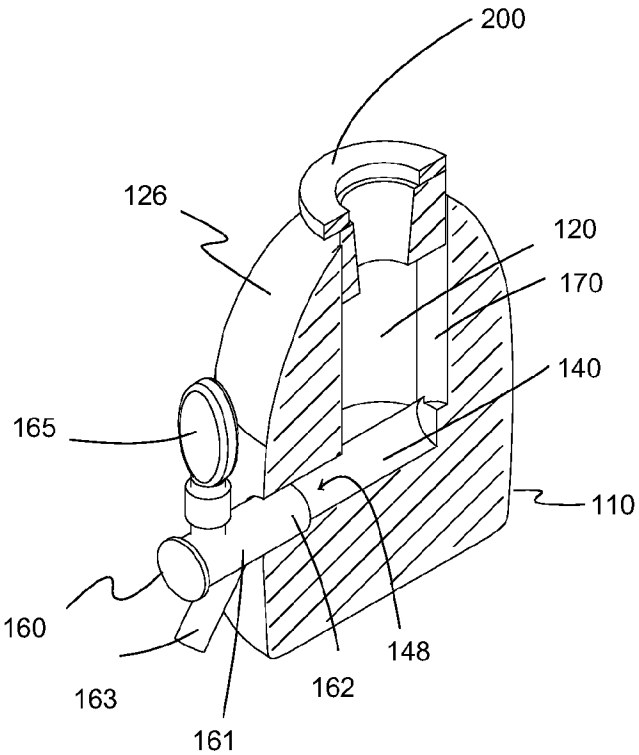
FIG. 8 illustrates a perspective sectional view of the embodiment of FIG. 8 and also showing a dispenser faucet and a cross-sectional view of an optional sleeve disposed in the vertically-inclined bore.
Figure 7:
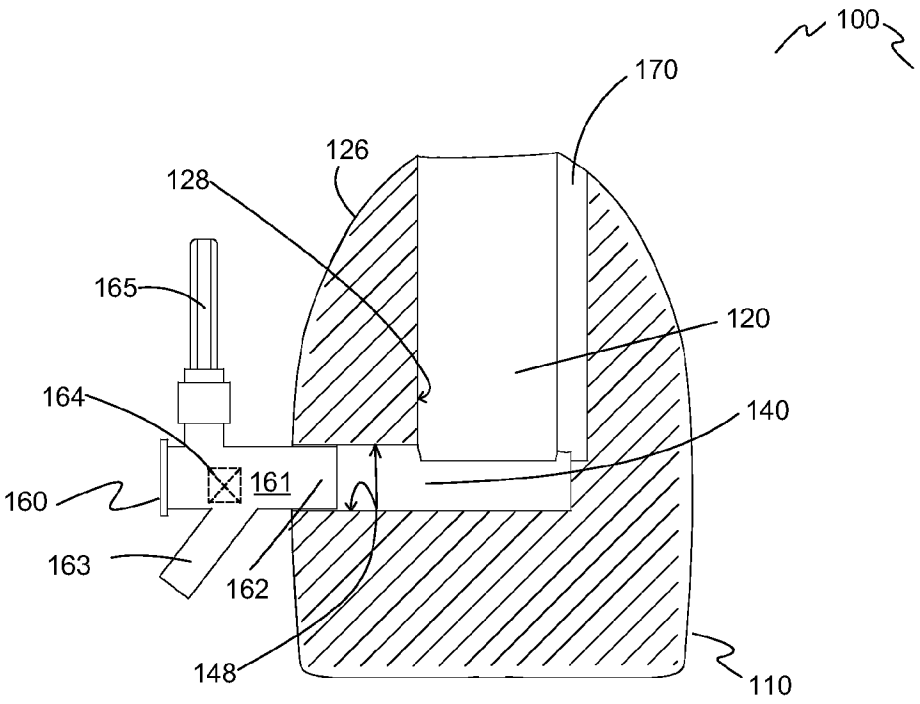
FIG. 7 illustrates a cross-sectional side view of one embodiment of a beverage dispenser of the present invention showing an optional dispenser faucet.

Now turning to FIGS. 7 and 8, there are shown side and perspective cross-sectional views, respectively, of another embodiment of beverage dispenser 100 with an optional dispensing faucet/spigot 160 sealingly disposed in valve bore 140. Faucet 160 preferably has a body 161, a faucet stem 162, a spout 163, a valve 164 (not shown), and a handle or actuator 165. In other embodiments, faucet 160 may simply be a shut-off valve connected to vent bore 140.

Faucet 160 controls the flow of liquid from the valve bore with a valve that opens or closes valve bore 140. Faucet stem 162 forms a liquid-tight seal with an inside surface 148 of valve bore 140. The liquid-tight seal may be accomplished by one or more methods of an adhesive (e.g., epoxy, silicone sealant, and the like) disposed between faucet stem 162 and inside surface 148 of valve bore 140, a threaded connection between faucet stem 162 and valve bore 140, a pressure-fit between faucet stem 162 and valve bore 140, and other methods known in the art. A pressure-fit may be accomplished, for example, by a faucet stem 162 having a tapered rubber or plastic sleeve that sufficiently deforms upon insertion into valve bore 140 to form a liquid-tight seal with inside surface 148 of valve bore 140.

FIG. 8 also shows one embodiment of an optional sleeve 200 disposed within vertically-inclined bore 120 and vent bore 170 of base 110. In one embodiment, sleeve 200 abuts inner surface 128 of vertically-inclined bore (and vent bore 170, when present) to form an air- or liquid-tight seal between sleeve 200 and base 110. Sleeve 200 will be discussed more fully below.

Figure 10:
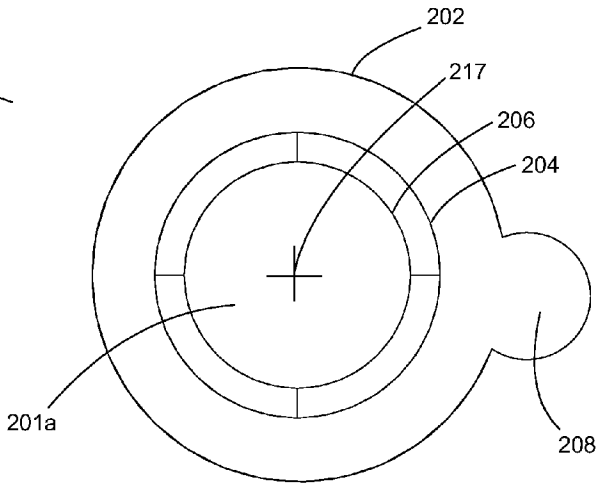
FIG. 10 illustrates a top view of the embodiment of a sleeve of the present invention shown in FIG. 9.
Figure 9:
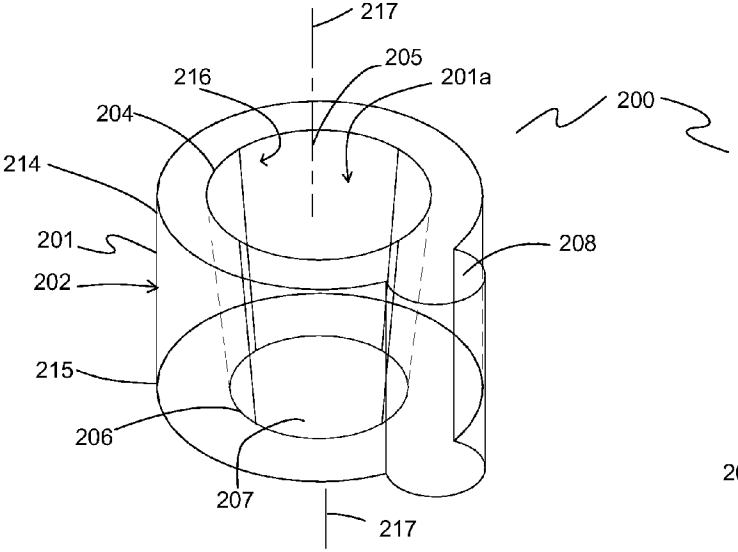
FIG. 9 illustrates a perspective view of one embodiment of a sleeve of the present invention and showing an optional protrusion.
Figure 11:
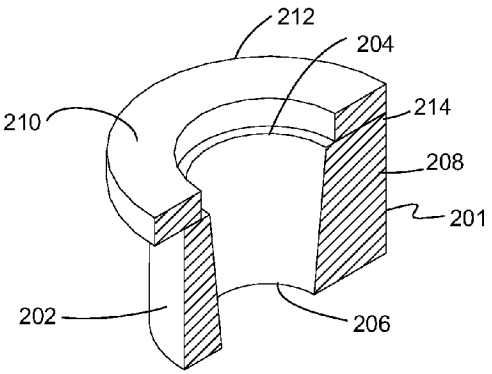
FIG. 11 illustrates a perspective sectional view of another embodiment of a sleeve of the present invention, showing a flanged portion and tapered inside surface.

Turning to FIGS. 9, 10, and 11, there are shown perspective, top, and perspective cross-sectional views, respectively, of embodiments of optional sleeve 200 adapted to fit within vertically-inclined bore 120 of base 110, preferably within upper portion 130 of base 110 (shown, for example in FIG. 2).

FIG. 9 illustrates an embodiment of sleeve 200 with an annular body 201, a passageway 201*a* through annular body 201 with central longitudinal axis 217, and an optional protrusion 208. Annular body 201 has an outer diameter 202 that is approximately equal to diameter D1 of opening 134 in upper outside surface 126 of base 110 (shown in FIG. 2). Annular body 201 has a sleeve first inner diameter 204 at a top opening 205 and a sleeve second inner diameter 206 at a bottom opening 207 of sleeve. Sleeve second inner diameter 206 is preferably approximately equal to sleeve first inner diameter 204 for a straight inside surface 216 of passageway 201*a*. More preferably, sleeve second inner diameter 206 is smaller than sleeve first inner diameter 204 to define inside surface 216 of passageway 201*a* that tapers from top 214 to bottom 215 for better engaging a neck of a beverage container as it is further downwardly inserted through passageway 201*a* of sleeve 200. Outer diameter 202 of annular body 201 may optionally decrease from a top 214 of sleeve to a bottom 215 of sleeve, thereby defining an outer diameter 202 of annular body 201 that tapers from top 214 to bottom 215 of sleeve 200.

FIG. 10 illustrates a top view of one embodiment of sleeve 200 with passageway 201*a* and optional protrusion 208. Protrusion 208 extends substantially parallel to central longitudinal axis 217 of sleeve 200 and is sized and shaped to occupy vent bore 170 without sealing vent bore or vertically-inclined bore 120 from fluid communication with the atmosphere. Protrusion 208 functions as a handle for sleeve 200 in addition to guiding placement of sleeve 200 within vertically-inclined bore 120. In one embodiment, sleeve 200 is made of a material that permits flow of air through sleeve 200 or contains venting conduits within the walls of sleeve 200 even when the outer surface of sleeve 200 forms a seal with inner surface 128 of vertically-inclined bore 120 and inside surface 172 of vent bore 170. In other embodiments, protrusion 208 is smaller than vent bore 170 to permit air flow into vent bore 170. In yet another embodiment, annular body 201 has vertical slots or grooves in an outside surface of annular body 201 or other features that permit fluid communication between the atmosphere and vertically-inclined bore 120. For example, as shown in the top view of FIG. 5, vent bore 170 appears as a smaller circle joined with a larger circle of vertically-inclined bore 120. A sleeve 200 for this embodiment of base 110 preferably has protrusion 208 that similarly appears as a smaller circle joined with larger circle structure of annular body 201 and is shaped to loosely fit within vertically-inclined bore 120 and vent bore 170. Sleeve 200 has outer diameter 202, sleeve first inner diameter 204, and sleeve second inner diameter 206. Sleeve second inner diameter 206 is smaller than sleeve first inner diameter 204.

FIG. 11 illustrates a perspective cross-sectional view of the embodiment of sleeve 200 shown in FIG. 8 that is shaped and configured for base 110 having both vertically-inclined bore 120 and vent bore 170. Sleeve 200 has optional protrusion 208 that is preferably shaped and configured to occupy or plug vent bore 170 and engage inside surface 172 of vent bore 170. Sleeve 200, however, is configured to not form an air- or liquid-tight seal with base 110 when disposed in vertically-inclined bore 120 (and vent bore 170, if present). To achieve a non-sealing interface between beverage container 300 and base 110, for example, protrusion 208 is omitted to maintain the external venting of vent bore 170 while providing a snug fit between base 110 and sleeve 200. Alternately, sleeve 200 is configured to merely reduce extra space between a slim neck of a beverage container and vertically-inclined bore 120. In a further embodiment, sleeve 200 is made of a material that allows atmospheric communication through sleeve 200 itself.

To prevent sleeve 200 from migrating down towards a lower portion 132 of vertically-inclined bore 120 where it may become stuck or difficult to remove, sleeve 200 optionally has a flanged portion 210 extending transversely and radially outward from top 214 of sleeve 200. Flanged portion 210 has an outer diameter 212 that is greater than outer diameter 202 of annular body 201 and greater than diameter D1 of opening 134 in upper outside surface 126 of base 110 (shown in FIG. 2) so that flanged portion 210 may rest on upper outside surface 126 of base 110 to prevent sleeve 200 from migrating downward into vertically-inclined bore 120 (shown in FIG. 8). Flange portion 210 may be fixedly attached to annular body 201 or it may be formed with annular body 201 as a unitary structure. As shown here, flanged portion 210 overlaps protrusion 208. Sleeve 200 of FIG. 11 also has sleeve first inner diameter 204 that is greater than sleeve second inner diameter 206

To make the present invention, a base 110 is selected from appropriate materials as described above. Base 110 is shaped as desired, if necessary. Base 110 preferably is a stone about four-and-a-half to six inches tall. A vertically-inclined bore 120 is formed through a upper outside surface 146 (or approximation thereof) of base 110, preferably by drilling. A vent bore 170 is optionally also formed through the upper outside surface 146, also preferably by drilling. A valve bore is formed into base 110 from a side wall 146 at a direction transverse to vertically-inclined bore 120, also preferably by drilling. If valve bore 140 does not intersect vertically-inclined bore 120, an additional opening or channel 160 is formed to connect the bores 120, 140. Channel 160 is preferably formed by drilling through bottom 132*a* of vertically-inclined bore 120 into valve bore 140.

An optional sealant 400 is applied to inside surface 128 of vertically-inclined bore, an inside surface 172 of vent bore (if present), and/or to inside surface 148 of valve bore. Alternately, base 110 is dipped into sealant 400. Sealant in one embodiment is water-based polyurethane. When base 110 is made of stone, an optional stone glamor or other oil-based sealant known in the art may be applied to any or all surfaces to protect base 110 from oil, water, and staining and to provide an improved "wet" appearance.

Optional dispensing faucet 160 is sealingly disposed into vent bore. In one embodiment, faucet stem 162 is secured within valve bore 140 by using an epoxy. In another embodiment, female threads are formed in an outer portion 150 of valve bore 140 to accept a threaded faucet stem 162. In another embodiment, the user applies a tape, sleeve, or other material over faucet stem 162 to form a liquid-tight pressure fit between faucet stem 162 and inside surface 148 of valve bore 140. The user operates handle 165 of dispensing faucet 160 to open a valve and dispense the beverage.

In situations where the user desires a tighter or more stable fit between neck 302 of beverage container 300 and vertically-inclined bore 120, the user may place an optional sleeve 200 (shown in FIGS. 10-12) over neck 302 of beverage container 300, insert the neck 302 with sleeve 200 into vertically-inclined bore 120, and adjust as needed. Sleeve 200 maintains a non-sealing interface between neck 302 and vertically-inclined bore 120. Alternately, the user may position optional sleeve 200 in vertically-inclined bore 120 and insert neck 302 of beverage container through annular opening of sleeve 200 into vertically-inclined bore 120.

Figure 12:
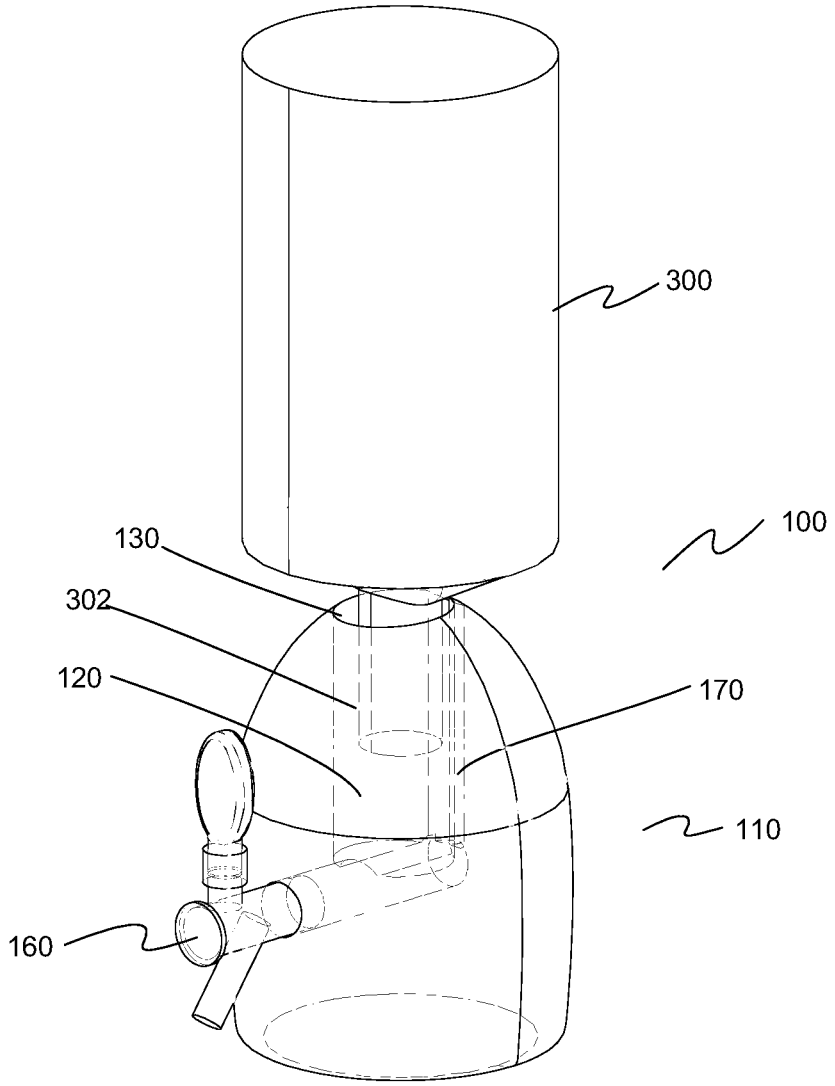
FIG. 12 illustrates a perspective view of an embodiment of beverage dispenser 100 in use with beverage container 300

FIG. 12 illustrates a perspective view of an embodiment of beverage dispenser 100 in use to dispense a beverage from beverage container 300. To use beverage dispenser 100, the user opens a bottle or other beverage container 300, inverts the container 300, and places the neck 302 of beverage container 300 into vertically-inclined bore 120 of base 110. The beverage fills vertically-inclined bore to at least the mouth 308 of beverage container 300. Because of the non-sealing interface between neck 302 and vertically-inclined bore 120, the beverage equilibrates with the atmosphere. As the beverage is dispensed through dispensing faucet 160, beverage is drained from beverage container and/or vertically-inclined bore 120. As the beverage level in vertically-inclined bore drops below mouth 308 of beverage container 300, air enters beverage container 300, equilibrating the beverage within beverage container 300 with the atmosphere. Because of the external venting feature of the invention, carbonated beverages cannot be dispensed effectively. Since carbonated beverages continue to release gas when opened to the atmosphere, pressure in beverage container 300 would build and cause the beverage to overflow out of the vent bore 170 or other venting mechanism used in conjunction with vertically-inclined bore 120 such as, for example, annular sleeve 200 having venting conduits, etc. In embodiments of beverage dispenser 100 having a threaded upper portion 130 of vertically-inclined bore 120, the user may screw the outer threaded neck 302 of beverage container 300 into vertically-inclined bore 120.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A beverage dispenser for use with a beverage container containing an alcoholic beverage, the beverage dispenser comprising:

a base with an upper outside surface;

a vertically-inclined bore within the base extending a first pre-defined distance into the base from the upper outside surface and defining an upper opening in the base, the vertically-inclined bore being sized to receive a neck portion of an inverted beverage container with a non-sealing interface between the inverted beverage container and the base;

a valve bore in fluid communication with and transverse to the vertically-inclined bore; and a vent formed in the base to maintain fluid communication between the vertically-inclined bore and the atmosphere external to the base;

wherein the base lacks any removable intervening structure adapted to be positioned between a mouth of the inverted beverage container and the base.

2. The beverage dispenser of claim 1 wherein at least a portion of the valve bore is threaded for threadably receiving one of a spigot, a valve, a dispensing faucet, or a fluid dispenser.

3. A beverage dispenser for use with a beverage container containing an alcoholic beverage, the beverage dispenser comprising:

a base with an upper outside surface;

a vertically-inclined bore within the base;

a valve bore in fluid communication with and transverse to the vertically-inclined bore; and a vent formed in the base to maintain fluid communication between the vertically-inclined bore and the atmosphere external to the base wherein the vertically-inclined bore extends a first pre-defined distance into the base from the upper outside surface and defines an upper opening in the base for receiving a neck portion of an inverted beverage container and wherein the valve bore extends a second pre-defined distance into the base and fluidly communicates with a lower portion of the vertically-inclined bore;

wherein at least a portion of the vertically-inclined bore is threaded and configured for threadably receiving a threaded neck portion of the beverage container.

4. The beverage dispenser of claim 1 further comprising a dispensing faucet having a faucet stem disposed in the valve bore wherein the faucet stem forms a liquid-tight seal with an inside surface of the valve bore for controlling the flow of a beverage from the beverage container through the valve bore.

5. The beverage dispenser of claim 4, wherein the liquid-tight seal is formed by one or more methods selected from the group consisting of an adhesive, a sealable threaded connection, and a pressure-fit.

6. The beverage dispenser of claim 1 wherein the vent includes a vent bore extending partially into the base from the upper outside surface and fluidly communicates with the vertically-inclined bore.

7. The beverage dispenser of claim 1 further comprising a sealant disposed on at least one of an inside surface and an outside surface of the base.

8. The beverage dispenser of claim 1 wherein the sealant is one of a water-based polyurethane and an oil-based sealant.

9. The beverage dispenser of claim 1 further comprising an annular sleeve removably insertable into an upper portion of the vertically-inclined bore and having an opening therethrough, the opening sized to receive the neck portion of the inverted beverage container inserted through the opening with the mouth positioned beyond the annular sleeve, wherein the annular sleeve includes a venting structure selected from the group consisting of (i) one or more longitudinal slots along an outside surface or an inside surface of the sleeve, (ii) one or more longitudinal grooves along an outside surface or an inside surface of the sleeve, and (iii) one or more longitudinal ridges along an outside surface or an inside surface of the sleeve.

10. The beverage dispenser of claim 9 wherein the annular sleeve includes a first inner diameter at a top opening and a second inner diameter at a bottom opening wherein the second inner diameter is smaller than the first inner diameter.

11. The beverage dispenser of claim 1 wherein the vent includes a vent bore intersecting the vertically-inclined bore along a major portion of the first pre-defined distance of the vertically-inclined bore.

12. In combination, a beverage dispenser and a beverage container, the combination comprising:

a beverage dispenser comprising:

a base with an upper outside surface;

a vertically-inclined bore within the base and extending a first pre-defined distance into the base from the upper outside surface and defining an upper opening in the base and sized to receive a neck portion of an inverted beverage container with a non-sealing interface between the inverted beverage container and the base;

a valve bore in fluid communication with and transverse to the vertically-inclined bore; and a vent formed in the base to maintain fluid communication between the vertically-inclined bore and the atmosphere external to the base wherein the base lacks any removable intervening structure adapted to be positioned between a mouth of the inverted beverage container and the base, wherein the removable intervening structure in combination with the base forms a vent pathway to the inverted beverage container; and a beverage container containing a non-carbonated, alcoholic beverage, wherein a neck of the beverage container is at least partially disposed within the vertically-inclined bore with the beverage container being in an inverted position.

13. The beverage dispenser of claim 12 wherein the alcoholic beverage is a distilled liquor.

* * * * *